US010584541B2

(12) United States Patent
Reddy et al.

(10) Patent No.: US 10,584,541 B2
(45) Date of Patent: Mar. 10, 2020

(54) PIPE HANDLING APPARATUS

(71) Applicant: Nabors Drilling Technologies USA, Inc., Houston, TX (US)

(72) Inventors: Padira Reddy, Richmond, TX (US); Ashish Gupta, Houston, TX (US); Denver Lee, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 15/656,894

(22) Filed: Jul. 21, 2017

(65) Prior Publication Data

US 2018/0030788 A1 Feb. 1, 2018

Related U.S. Application Data

(60) Provisional application No. 62/367,977, filed on Jul. 28, 2016.

(51) Int. Cl.

| | |
|---|---|
| ***E21B 15/00*** | (2006.01) |
| ***E21B 19/14*** | (2006.01) |
| ***E04H 12/34*** | (2006.01) |

(52) U.S. Cl.

CPC ..... *E21B 15/00* (2013.01); *E04H 12/345* (2013.01); *E21B 15/003* (2013.01); *E21B 19/14* (2013.01)

(58) Field of Classification Search

CPC ..... E21B 15/00; E21B 19/15; E21B 19/155; E21B 19/20; E04H 12/345

USPC ..... 414/22.51–22.71

See application file for complete search history.

(56) References Cited

U.S. PATENT DOCUMENTS

| | | | |
|---|---|---|---|
| 1,733,484 | A | 10/1929 | Davis |
| 2,332,479 | A | 10/1943 | Woolslayer et al. |
| 2,345,253 | A | 3/1944 | Funk |
| 2,347,115 | A | 4/1944 | Lewis |
| 2,594,847 | A | 4/1952 | Bates et al. |
| 3,028,881 | A | 4/1962 | Koomey et al. |
| 3,255,836 | A | 6/1966 | Hoppmann et al. |
| 3,433,268 | A | 3/1969 | Greer |
| 3,483,933 | A | 12/1969 | Dyer et al. |

(Continued)

FOREIGN PATENT DOCUMENTS

| | | | |
|---|---|---|---|
| CA | 2755483 | A1 | 11/2010 |
| CA | 2753417 | A1 | 2/2011 |

(Continued)

OTHER PUBLICATIONS www.peerless-ca-trailers, "Oil and Gas, Drilling and Well Servicing" , 2014 (Year: 2014).*

(Continued)

*Primary Examiner* — Lynn E Schwenning
(74) *Attorney, Agent, or Firm* — Adolph Locklar

(57) ABSTRACT

A pipe handling apparatus includes a lower mast, upper mast, and trailer. The lower mast and upper mast may be pivotably coupled at a hinge point. The trailer may be coupled to the lower mast by a hydraulic cylinder. The pipe handling apparatus may be transported to a drilling rig and the lower mast mechanically coupled to the drilling rig. The upper mast may be pivoted relative to the lower mast at the hinge point. The lower mast and upper mast may be pivoted from the horizontal position to the vertical position by the hydraulic cylinder.

20 Claims, 8 Drawing Sheets

(56) References Cited

U.S. PATENT DOCUMENTS 3,676,984 A 7/1972 Clark
3,716,149 A 2/1973 Scaggs
3,739,853 A 6/1973 Wales
3,802,137 A 4/1974 Armstrong
3,851,770 A * 12/1974 Jenkins ..... E21B 15/00 414/22.56
3,922,825 A 12/1975 Eddy et al.
3,937,334 A * 2/1976 Bleyl ..... E21B 15/04 414/22.53
3,942,593 A 3/1976 Reeve, Jr. et al.
3,991,887 A * 11/1976 Trout ..... E21B 19/155 414/22.52
4,021,978 A 5/1977 Busse et al.
4,029,165 A 6/1977 Miller et al.
RE29,541 E 2/1978 Russell
4,117,941 A 10/1978 McCleskey et al.
4,221,088 A 9/1980 Patterson
4,235,566 A 11/1980 Beeman et al.
4,267,675 A * 5/1981 Cochran ..... E21B 7/023 212/348
4,290,495 A * 9/1981 Elliston ..... E21B 7/02 166/77.4
4,403,898 A 9/1983 Thompson
4,407,629 A * 10/1983 Willis ..... E21B 19/155 175/52
4,421,179 A 12/1983 Boyadjieff
4,473,977 A * 10/1984 Reed ..... E21B 15/00 182/115
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A 5/1986 Woolslayer et al.
4,744,710 A 5/1988 Reed
4,757,592 A 7/1988 Reed
4,759,414 A 7/1988 Willis
4,823,870 A 4/1989 Sorokan
4,834,604 A 5/1989 Brittain et al.
4,837,992 A * 6/1989 Hashimoto ..... E21B 15/00 52/118
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A 2/1996 Suksumake
5,921,336 A 7/1999 Reed
6,161,358 A 12/2000 Mochizuki et al.
6,343,892 B1 * 2/2002 Kristiansen ..... E21B 15/00 405/195.1
6,491,477 B2 12/2002 Bennett, Jr. et al.
6,581,525 B2 6/2003 Smith
6,634,436 B1 10/2003 Desai
6,779,614 B2 8/2004 Oser
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,255,180 B2 8/2007 Beato et al.
7,306,055 B2 12/2007 Barnes
7,308,953 B2 12/2007 Barnes
7,401,656 B2 7/2008 Wood et al.
7,404,697 B2 7/2008 Thompson
7,600,585 B2 10/2009 Patton et al.
7,628,229 B2 12/2009 Wood et al.
7,765,749 B2 8/2010 Palidis
7,819,207 B2 10/2010 Cowan
7,832,974 B2 11/2010 Fikowski et al.
7,931,076 B2 4/2011 Ditta et al.
7,967,540 B2 6/2011 Wright et al.
7,992,646 B2 8/2011 Wright et al.
8,051,930 B1 11/2011 Barnes et al.
8,181,698 B2 5/2012 Springett et al.
8,250,816 B2 8/2012 Donnally et al.
8,297,362 B1 10/2012 Strider et al.
8,468,753 B2 6/2013 Donnally et al.
8,474,216 B1 7/2013 Goerner
8,516,751 B2 8/2013 Konduc et al.
8,549,815 B2 10/2013 Donnally et al.
8,555,564 B2 10/2013 Wasterval
8,561,685 B2 10/2013 Rodgers
8,661,743 B2 3/2014 Flusche
8,720,128 B2 5/2014 Vogt
8,813,436 B2 8/2014 Donnally et al.
8,863,449 B2 10/2014 Donnally et al.
8,904,716 B2 12/2014 Donnally et al.
8,936,424 B1 * 1/2015 Barnes ..... E21B 19/02 414/22.63
8,985,238 B2 3/2015 Sorokan et al.
8,997,435 B2 4/2015 Reddy et al.
9,016,004 B2 4/2015 Vogt
9,027,287 B2 5/2015 Trevithick et al.
9,091,125 B2 7/2015 Konduc et al.
9,091,126 B2 7/2015 Thiessen et al.
9,091,128 B1 * 7/2015 Orgeron ..... E21B 19/14
9,132,871 B2 9/2015 Crisp et al.
9,140,080 B2 9/2015 Flusche
9,151,412 B2 10/2015 Trevithick et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,488,014 B2 11/2016 Sparkman et al.
9,562,407 B2 2/2017 Magnuson
9,631,443 B2 4/2017 Folk
9,650,840 B2 5/2017 Cheng et al.
9,677,298 B2 6/2017 Konduc et al.
9,708,861 B2 7/2017 Reddy et al.
9,790,751 B2 10/2017 Reddy et al.
9,810,027 B2 11/2017 Reddy et al.
9,845,813 B2 12/2017 Shimizu et al.
9,879,442 B2 1/2018 Magnuson et al.
9,926,719 B2 3/2018 Reddy et al.
2002/0001255 A1 * 1/2002 Flood ..... B28C 7/0486 366/8
2003/0172599 A1 9/2003 Frink
2008/0237170 A1 10/2008 Altman et al.
2008/0251267 A1 * 10/2008 Cicognani ..... E21B 7/023 173/1
2009/0000218 A1 1/2009 Lee et al.
2009/0025980 A1 1/2009 Callander et al.
2009/0053013 A1 2/2009 Maltby
2009/0159294 A1 * 6/2009 Abdollahi ..... E21B 19/14 166/377
2009/0200856 A1 8/2009 Chehade et al.
2009/0272540 A1 11/2009 Rodgers
2010/0034619 A1 * 2/2010 Orgeron ..... E21B 19/155 414/22.55
2010/0329823 A1 * 12/2010 Baumler ..... E21B 19/165 414/22.55
2011/0072737 A1 3/2011 Wasterval
2011/0174545 A1 7/2011 Hartke et al.
2012/0168179 A1 7/2012 Havinga et al.
2012/0304553 A1 12/2012 Konduc et al.
2013/0302114 A1 * 11/2013 Reddy ..... E21B 3/02 414/22.55
2013/0305632 A1 11/2013 Rivera, Sr. et al.

(56) References Cited

U.S. PATENT DOCUMENTS

| | | | | |
|---|---|---|---|---|
| 2013/0343836 | A1* | 12/2013 | Flusche | B23P 11/00 414/22.55 |
| 2014/0014417 | A1 | 1/2014 | Smith et al. | |
| 2014/0054097 | A1 | 2/2014 | Bryant et al. | |
| 2014/0133939 | A1* | 5/2014 | Richardson | E21B 19/14 414/22.55 |
| 2014/0298735 | A1* | 10/2014 | Vogt | E21B 7/023 52/118 |
| 2015/0259984 | A1* | 9/2015 | Taggart | E21B 7/023 175/57 |
| 2015/0300104 | A1* | 10/2015 | Orgeron | E21B 19/14 414/22.56 |
| 2015/0315861 | A1 | 11/2015 | Zachariasen et al. | |
| 2016/0186495 | A1 | 6/2016 | Flusche | |
| 2016/0215592 | A1 | 7/2016 | Helms et al. | |
| 2016/0280524 | A1 | 9/2016 | Crisp et al. | |
| 2016/0369570 | A1 | 12/2016 | Reddy et al. | |
| 2017/0106925 | A1 | 4/2017 | Gupta et al. | |
| 2017/0292334 | A1 | 10/2017 | Reddy et al. | |
| 2017/0350153 | A1 | 12/2017 | Reddy et al. | |
| 2018/0016851 | A1 | 1/2018 | Reddy et al. | |
| 2018/0119496 | A1 | 5/2018 | Reddy et al. | |
| 2018/0128056 | A1 | 5/2018 | Gupta et al. | |

FOREIGN PATENT DOCUMENTS

| | | | |
|---|---|---|---|
| CN | 201778661 | U | 3/2011 |
| DE | 849533 | C | 9/1952 |
| EP | 2751370 | B1 | 7/2014 |
| FR | 2556042 | A1 | 6/1985 |
| WO | 2016025521 | A2 | 2/2016 |
| WO | 2016048458 | A1 | 3/2016 |

OTHER PUBLICATIONS

Nabors 990 Proyecto Llanos_WMV; https://www.youtube.com/watch?v=6BgfgWumRIU, Nabors Rig 990 Chichimene, Colombia; Youtube.com; Aug. 10, 2011 (231 pages).

Drilling Contractor; "Nabors modular Rig 702 in Papua New Guinea—bound for ExxonMobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

Gaddy, Dean E., "Critical path analysis improves rig-moving procedures", Oil & Gas Journal, Nov. 16, 1998 (5 pages).

* cited by examiner

PIPE HANDLING APPARATUS

CROSS REFERENCE TO RELATED APPLICATIONS

This application is a U.S. non-provisional application which claims priority from U.S. provisional application No. 62/367,977, filed Jul. 28, 2016, which is incorporated by reference herein in its entirety.

TECHNICAL FIELD/FIELD OF THE DISCLOSURE

The present disclosure relates to a drilling rig and specifically a pipe handling apparatus for a drilling rig.

BACKGROUND OF THE DISCLOSURE

When drilling a wellbore, a drill string is extended from the drilling rig into the wellbore. The drill string includes a bit at its lowermost end. The drill string is typically formed from a plurality of end-to-end joined pipe sections. As the wellbore is drilled, additional lengths of drill pipe are added to the drill string to increase the length thereof. The additional lengths of drill pipe, typically sections of two or three individual drill pipes known collectively as a pipe stand, may be stored vertically on the drilling rig. The pipe stands are typically placed standing up on the drilling floor supported by fingerboards at an upper position. The fingerboards separate the stored pipe stands into rows, and prevent the pipe stands from falling over. Typically, the pipe stands lean towards the back of the fingerboard.

SUMMARY

The present disclosure provides for a pipe handling apparatus for a drilling rig. The pipe handling apparatus may include a lower mast. The pipe handling apparatus may further include an upper mast pivotably coupled to the lower mast at a hinge point. The pipe handling apparatus may further include a trailer mechanically coupled to the lower mast by a lifting hydraulic cylinder.

The present disclosure also provides for a method. The method may include providing a pipe handling apparatus. The pipe handling apparatus may include a lower mast including a rig coupler. The pipe handling apparatus may include an upper mast pivotably coupled to the lower mast at a hinge point. The pipe handling apparatus may include a trailer. The method may include transporting the pipe handling apparatus to a drilling rig, mechanically coupling the lower mast to the drilling rig with the rig coupler and a coupling point of the drilling rig, pivoting the upper mast relative to the lower mast at the hinge point, and lifting the lower mast and upper mast from a horizontal position to a vertical position using a lifting hydraulic cylinder mechanically coupled between the lower mast and the trailer.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
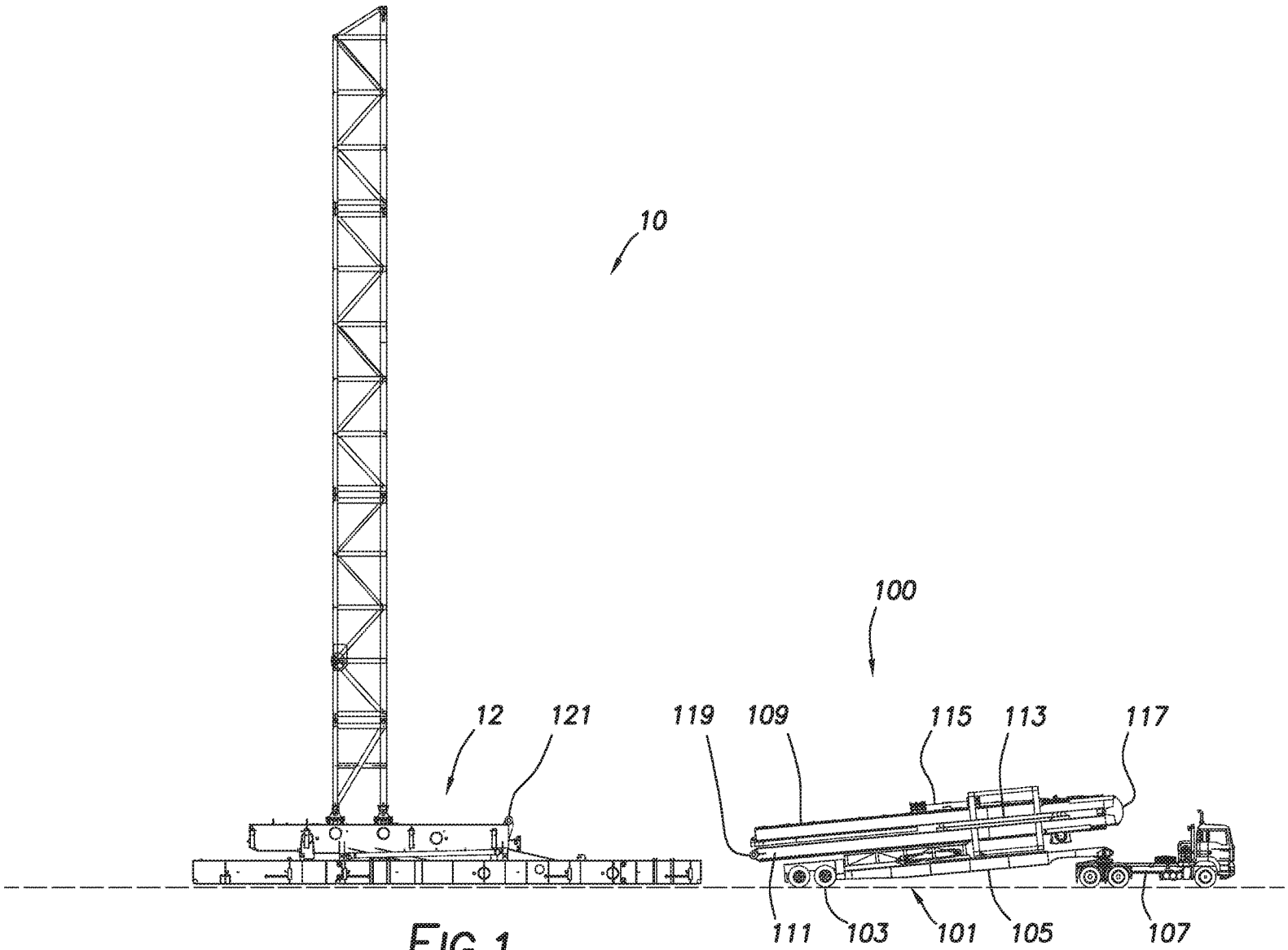
FIG. 1 depicts a side view of a pipe handling apparatus consistent with at least one embodiment of the present disclosure and a drilling rig.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling rig 10 and pipe handling apparatus 100. Drilling rig 10 is shown and described herein as a slingshot rig, but may be any land-based drilling rig. FIG. 1 depicts drilling rig 10 in a drilling floor-lowered position.

In some embodiments, pipe handling apparatus 100 may be configured to be transported by trailer 101. In some embodiments, trailer 101 may be a rockover trailer having wheels 103 and trailer body 105. In some embodiments, pipe handling apparatus 100 may be transported within a wellsite and between wellsites by truck 107 using trailer 101. In some embodiments, pipe handling apparatus 100 may include upper mast 109 and lower mast 111. In some embodiments, upper mast 109 may be pivotably coupled to lower mast 111 at hinge point 117. In some embodiments, pipe handling apparatus 100 may include fingerboards 113 and pipe handler 115 as discussed further herein below.

In some embodiments, pipe handling apparatus 100 may be transportable in a collapsed position as depicted in FIG. 1, in which upper mast 109 is pivoted at hinge point 117 to be substantially parallel to and proximate lower mast 111. Upper mast 109 and lower mast 111 may be substantially horizontal when in the collapsed position. In some embodiments, pipe handling apparatus 100 may be sized such that pipe handling apparatus 100 complies with one or more transportation regulations. For example and without limitation, in some embodiments, pipe handling apparatus 100 and trailer 101 may be formed such that pipe handling apparatus 100 is at most 8'6" (2.6 m wide. In some embodiments, pipe handling apparatus 100 and trailer 101 may be formed such that pie handling apparatus 100 is at most 9'6" (2.9 m in height. By forming pipe handling apparatus 100 within these or other applicable size limits, pipe handling apparatus 100 may be a non-permit load when transported in the collapsed position.

Figure 2:
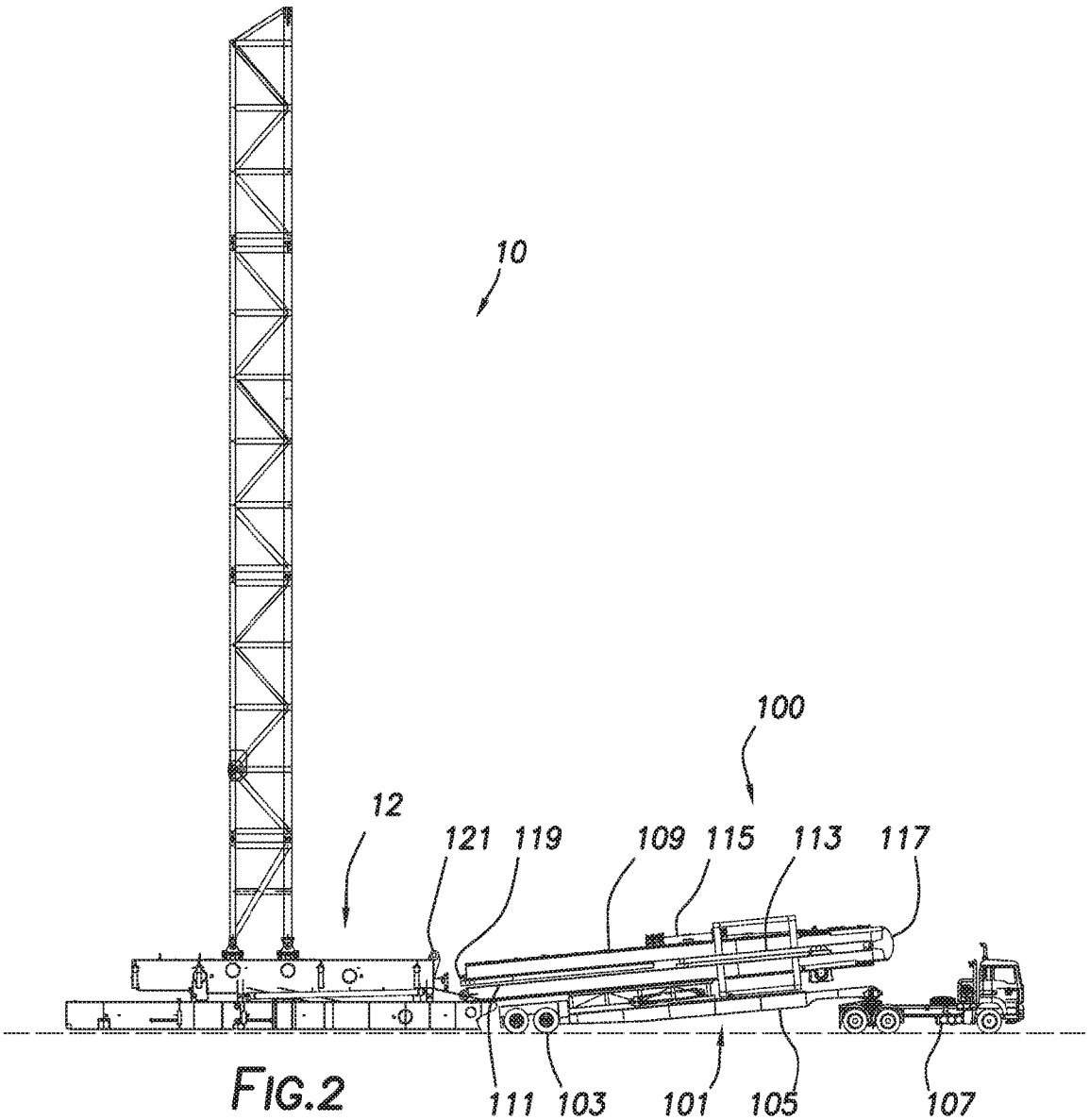
FIG. 2 depicts the pipe handling apparatus and drilling rig of FIG. 1 in an alternate position.

In some embodiments, to rig up pipe handling apparatus 100 to drilling rig 10 and position pipe handling apparatus 100 to an operational position as described herein below, pipe handling apparatus 100 may be transported to the wellsite at which drilling rig 10 is located. In some embodiments, pipe handling apparatus 100 may be transported to be proximal to V-door side 12 of drilling rig 10 as depicted in FIG. 2. As used herein, V-door side 12 of drilling rig 10 refers to the side of drilling rig 10 through which tubular members such as, for example and without limitation, drill pipe and casing is introduced onto drilling rig 10 by pipe handling apparatus 100. In some embodiments, V-door side 12 of drilling rig 10 may correspond with the side of drilling rig 10 at which a V-door (not shown) is located, however the use of the term "V-door side" is not intended to limit the scope of this disclosure to a drilling rig 10 having a V-door.

Figure 3:
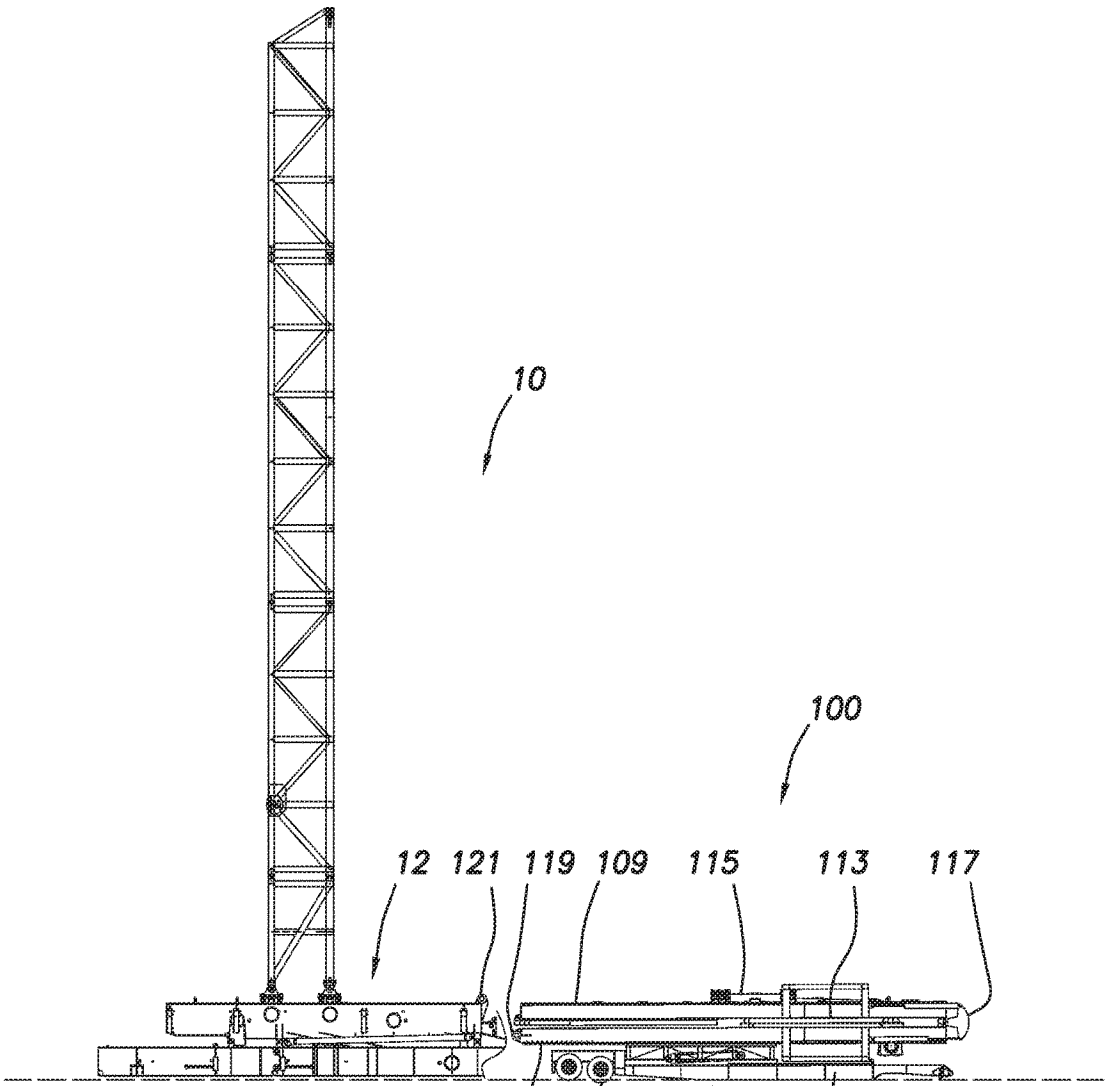
FIG. 3 depicts the pipe handling apparatus and drilling rig of FIG. 1 in an alternate position.

In some embodiments, once pipe handling apparatus 100 is positioned proximal to drilling rig 10, truck 107 may be disconnected from trailer 101 as depicted in FIG. 3. In some such embodiments, trailer body 105 may be positioned on the ground.

In some embodiments, lower mast 111 may include one or more rig couplers 119. Rig couplers 119 may, in some embodiments, be connection points for mechanically coupling pipe handling apparatus 100 to drilling rig 10. In some embodiments, drilling rig 10 may include one or more corresponding coupling points 121 positioned to receive rig couplers 119. In some embodiments, rig couplers 119 and coupling points 121 may mechanically couple pipe handling apparatus 100 to drilling rig 10 such that pipe handling apparatus 100 may pivot relative to drilling rig 10 as discussed further herein below.

Figure 4:
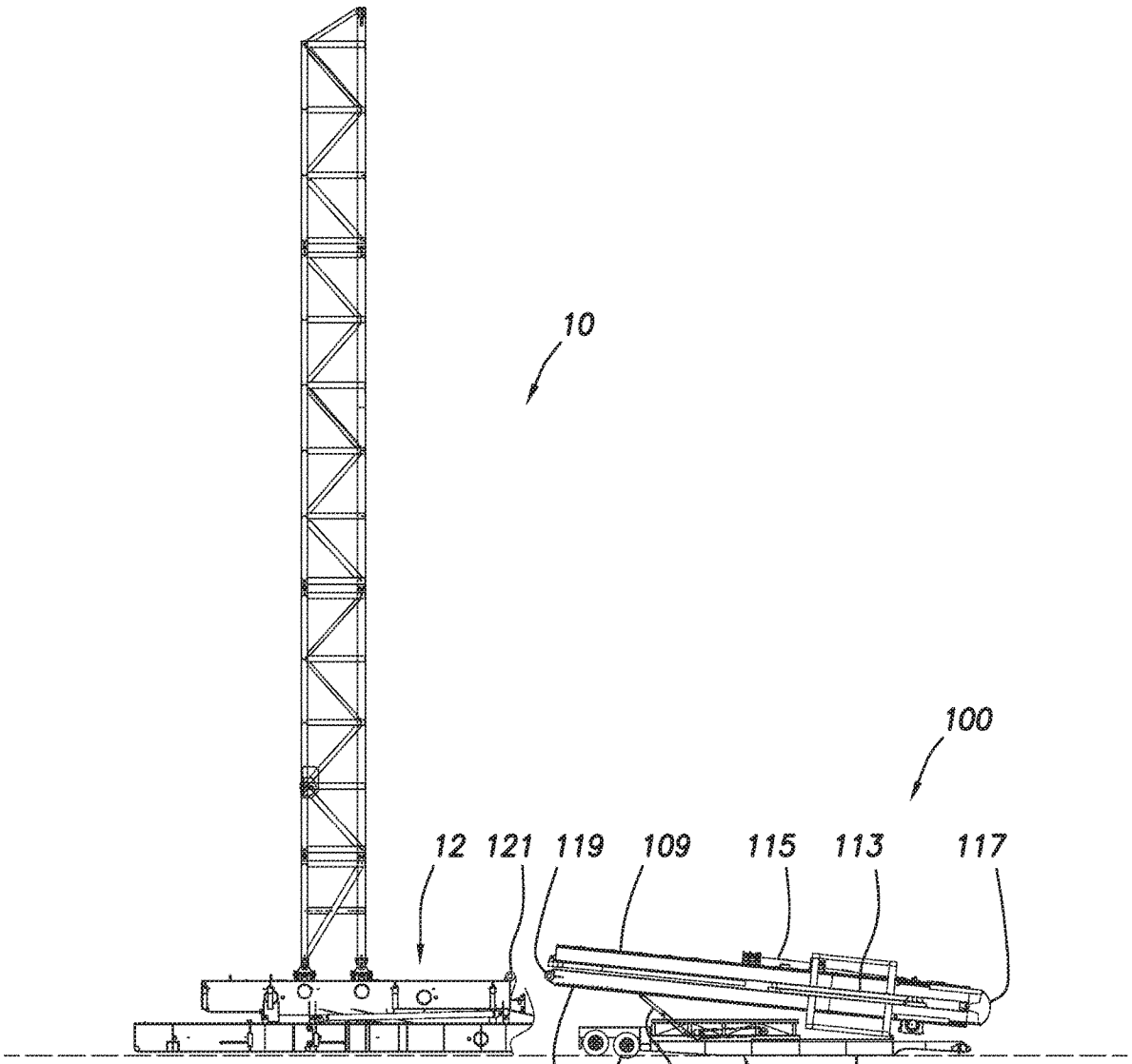
FIG. 4 depicts the pipe handling apparatus and drilling rig of FIG. 1 in an alternate position.
Figure 5:
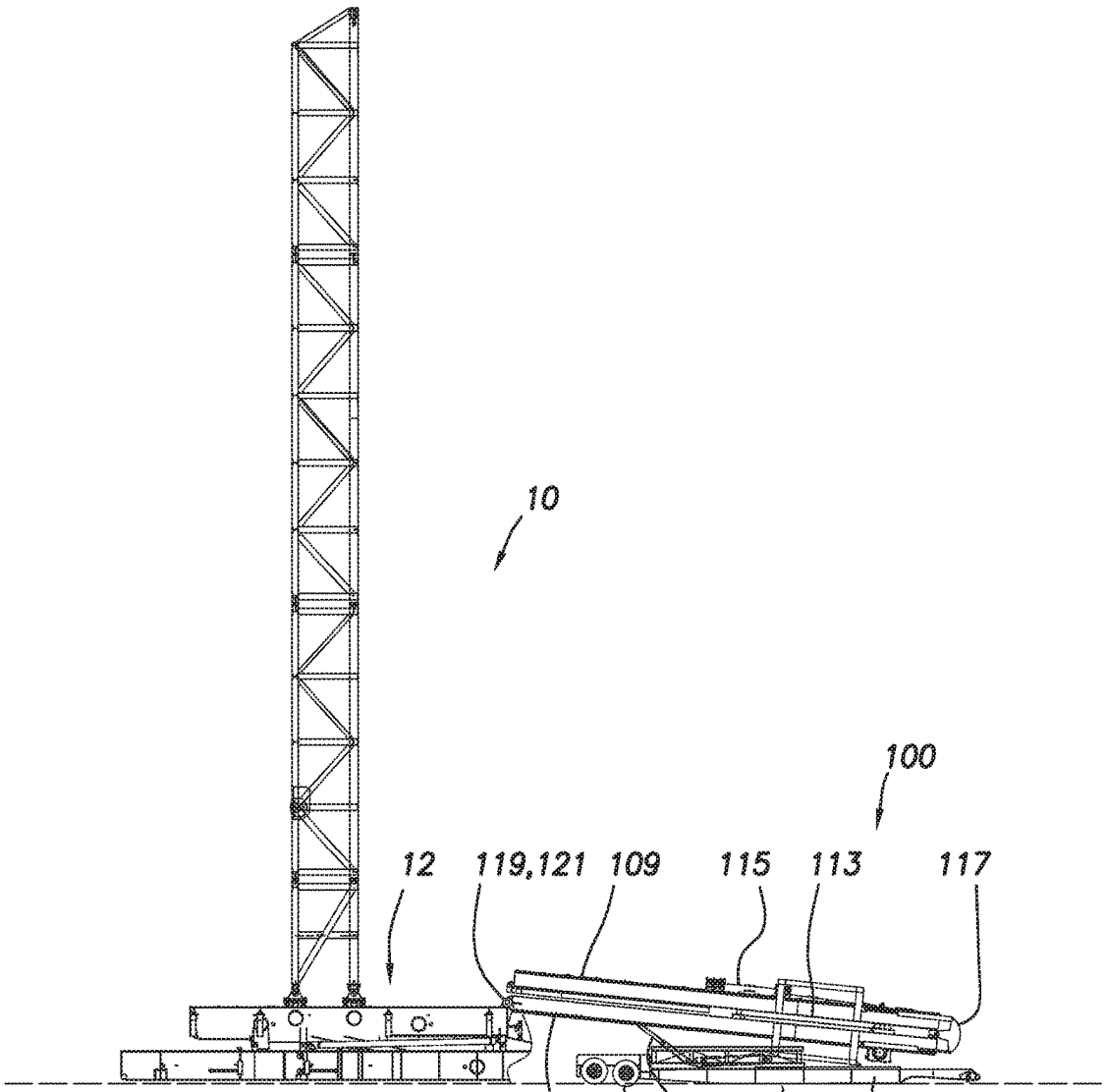
FIG. 5 depicts the pipe handling apparatus and drilling rig of FIG. 1 in an alternate position.

In some embodiments, as depicted in FIG. 4, one or more positioning hydraulic cylinders 123 may be coupled between trailer 101 and lower mast 111. Positioning hydraulic cylinders 123 may in some embodiments be utilized to lift upper and lower masts 109, 111 such that rig couplers 119 are aligned with the height of coupling points 121. In some embodiments, as depicted in FIG. 5, positioning hydraulic cylinders 123 may be used to move upper and lower masts 109, 111 such that rig couplers 119 engage coupling points 121. In some embodiments, one or more fasteners such as pins may be inserted to mechanically couple rig couplers 119 with coupling points 121.

Figure 6:
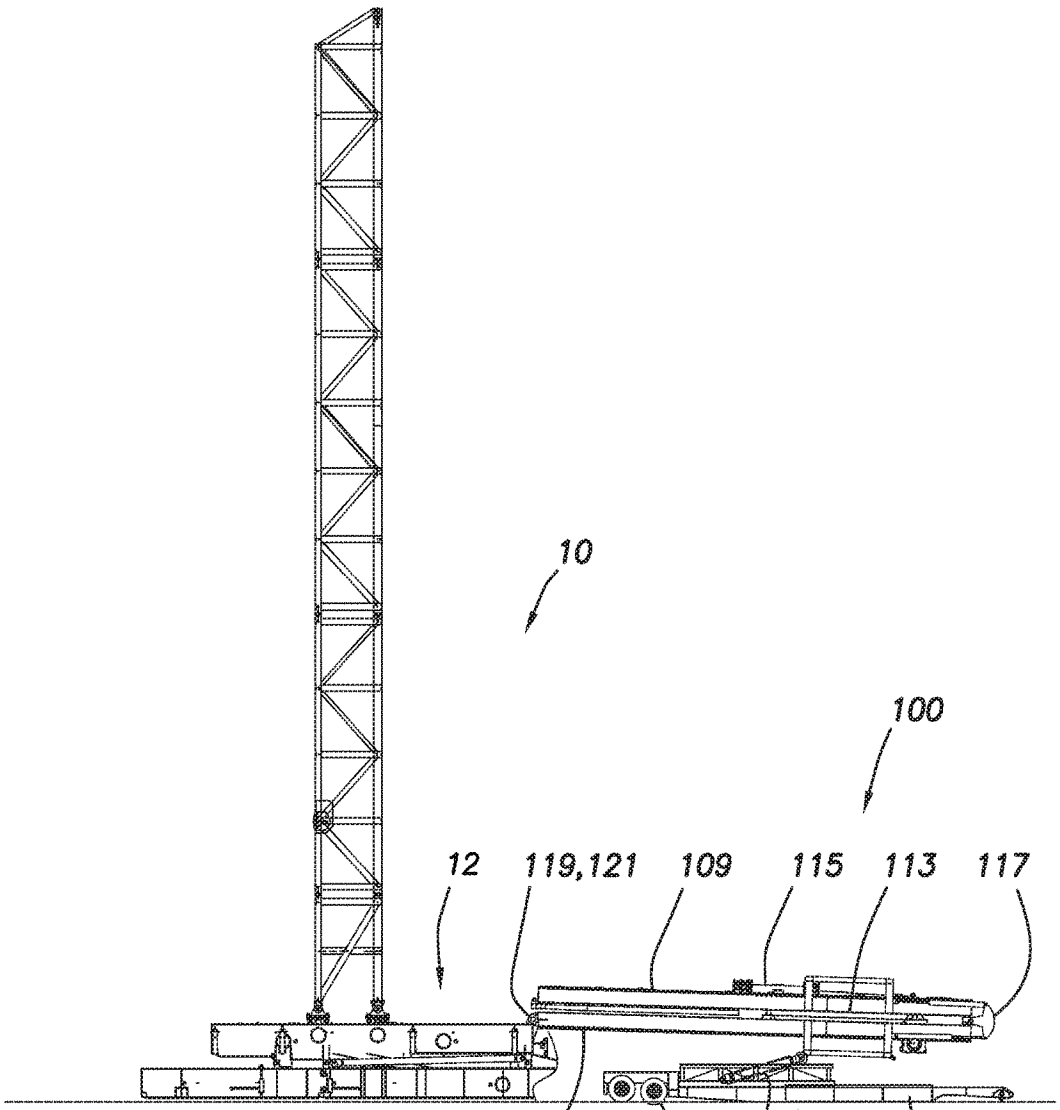
FIG. 6 depicts the pipe handling apparatus and drilling rig of FIG. 1 in an alternate position.
Figure 7:
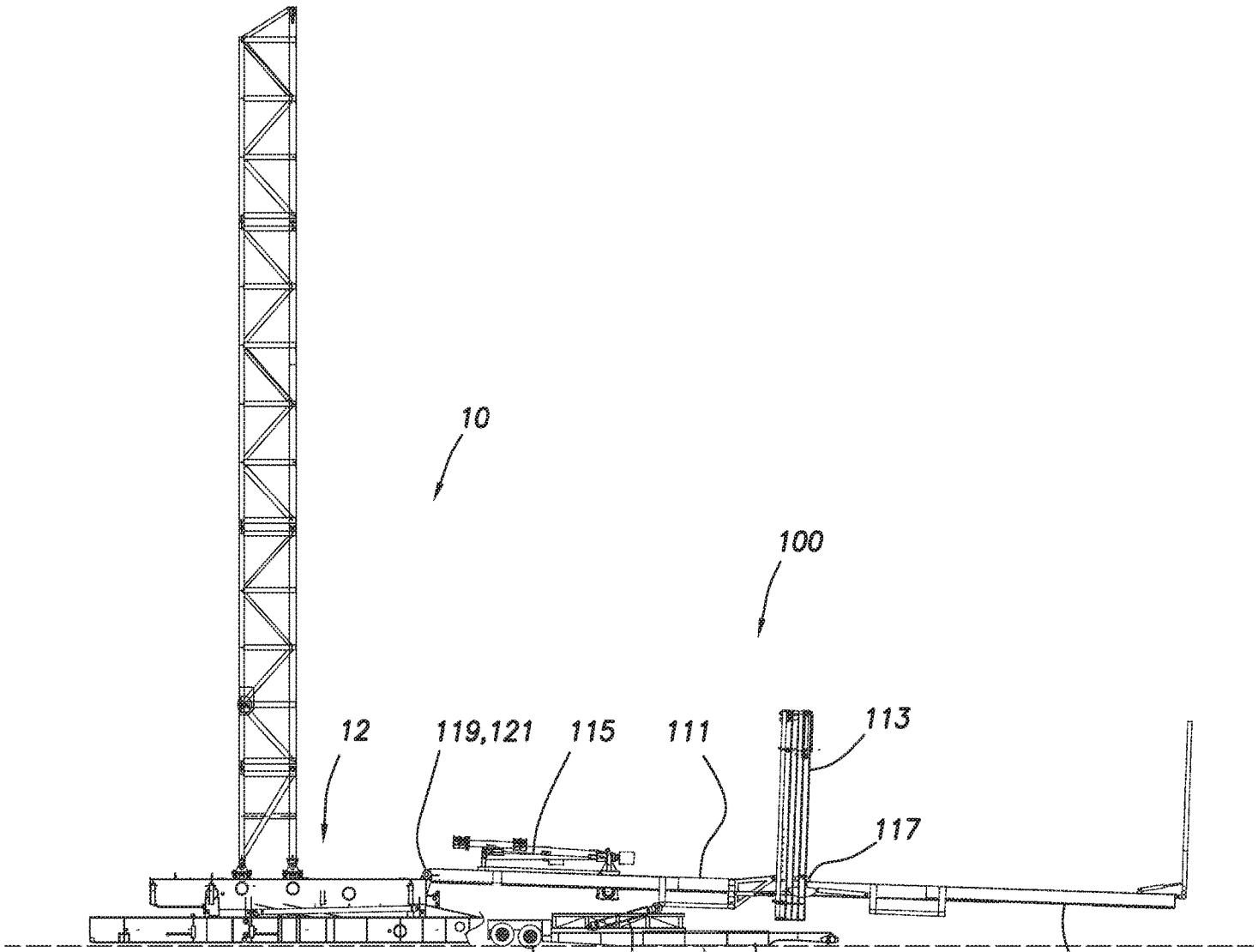
FIG. 7 depicts the pipe handling apparatus and drilling rig of FIG. 1 in an alternate position.
Figure 8:
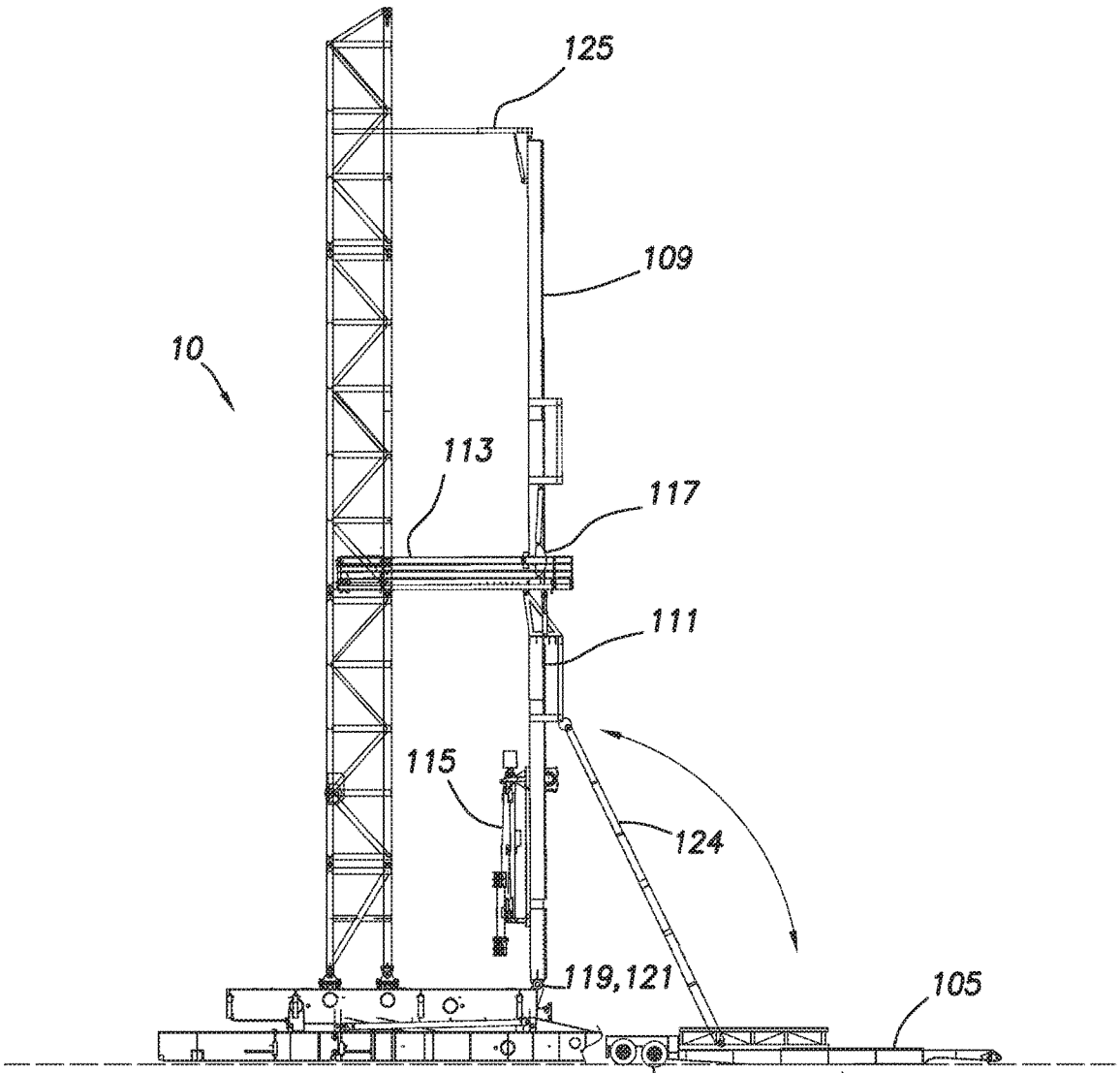
FIG. 8 depicts the pipe handling apparatus and drilling rig of FIG. 1 in an alternate position.

In some embodiments, as depicted in FIG. 6, one or more lifting hydraulic cylinders 124 may mechanically couple between trailer 101 and lower mast 111. Lifting hydraulic cylinders 124 may in some embodiments be used to lift upper and lower masts 109, 111 into a raised position as further described below. In some embodiments, positioning hydraulic cylinders 123 may be used as lifting hydraulic cylinders 124. In some embodiments, lifting hydraulic cylinders 124 may raise upper and lower masts 109, 111 to be substantially horizontal by pivoting upper and lower masts 109, 111 at rig couplers 119. In some embodiments, as depicted in FIG. 7, upper mast 109 may be pivoted relative to lower mast 111 at hinge point 117. In some embodiments, fingerboards 113 may pivot into the deployed positions as depicted in FIG. 7. In some embodiments, fingerboards 113 may be provided separately from pipe handling apparatus 100 and may be mechanically coupled to pipe handling apparatus 100. Lifting hydraulic cylinders 124 may then be used to lift pipe handling apparatus 100 into the vertical position as depicted in FIG. 8. In some embodiments, pipe handling apparatus 100 may be mechanically coupled to drilling rig 10 by upper beam 125, which may be pivotably coupled to upper mast 109. Lifting hydraulic cylinders 124 may be decoupled from lower mast 111, and trailer 101 may be transported away from drilling rig 10 for storage.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the scope of the present disclosure and that they may make various changes, substitutions, and alterations herein without departing from the spirit and scope of the present disclosure.

What is claimed is:

1. A pipe handling apparatus for a drilling rig transportable separately from the drilling rig comprising:
- a lower mast;
- an upper mast, the upper mast pivotably coupled to the lower mast at a hinge point, the lower mast and upper mast distinct from a mast of the drilling rig; and
- a trailer, the trailer mechanically coupled to the lower mast by a lifting hydraulic cylinder.

2. The pipe handling apparatus of claim 1, further comprising a fingerboard.

3. The pipe handling apparatus of claim 1, further comprising a pipe handler.

4. The pipe handling apparatus of claim 1, wherein the lower mast further comprises a rig coupler, the rig coupler mechanically and pivotably coupled to a coupling point on a V-door side of a drilling rig.

5. The pipe handling apparatus of claim 4, further comprising a positioning hydraulic cylinder mechanically coupled between the trailer and the lower mast such that the rig coupler is aligned with a height of the coupling point.

6. The pipe handling apparatus of claim 5, wherein the positioning cylinders is adapted to raise the upper and lower mast to be substantially horizontal.

7. The pipe handling apparatus of claim 1, wherein the trailer is a rockover trailer.

8. The pipe handling apparatus of claim 1, wherein the upper mast and the lower mast are substantially parallel in a lowered position or in a raised position.

9. The pipe handling apparatus of claim 8, wherein the upper mast and lower mast are substantially horizontal in a collapsed position.

10. The pipe handling apparatus of claim 9, wherein the pipe handling apparatus is less than 8' 6" wide and less than 9' 6" high when the upper mast and lower mast are in a collapsed position.

11. A method comprising:
- providing a pipe handling apparatus, the pipe handling apparatus including:
  - a lower mast including a rig coupler;
  - an upper mast, the upper mast pivotably coupled to the lower mast at a hinge point; and
  - a trailer;
- transporting the pipe handling apparatus to a drilling rig, the drilling rig having a mast distinct from the upper and lower mast of the pipe handling apparatus;
- mechanically coupling the lower mast to a V-door side of the drilling rig with the rig coupler and a coupling point of the drilling rig;
- pivoting the upper mast relative to the lower mast at the hinge point; and lifting the lower mast and upper mast from a horizontal position to a vertical position using a lifting hydraulic cylinder mechanically coupled between the lower mast and the trailer.

12. The method of claim 11, wherein mechanically coupling the lower mast to the drilling rig further comprises aligning the rig coupler with the coupling point of the drilling rig.

13. The method of claim 12, wherein aligning the rig coupler with the coupling point of the drilling rig further comprises lifting the lower mast with a positioning hydraulic cylinder mechanically coupled between the trailer and the lower mast.

14. The method of claim 13, wherein the positioning hydraulic cylinder is the lifting hydraulic cylinder.

15. The method of claim 11, wherein the pipe handling apparatus further comprises a fingerboard pivotably coupled to the upper or lower mast, and the method further comprises pivoting the fingerboard into a deployed position.

16. The method of claim 11, further comprising mechanically coupling a fingerboard to the upper or lower mast.

17. The method of claim 11, further comprising mechanically coupling the upper mast to the drilling rig with an upper beam that is pivotably coupled to the upper mast.

18. The method of claim 11, wherein the trailer is a rockover trailer.

19. The method of claim 11, wherein transporting the pipe handling apparatus to the drilling rig is performed with the upper mast and the lower mast substantially horizontal.

20. The method of claim 11 further comprising after the step of lifting the lower mast and upper mast from a horizontal position to a vertical position:

decoupling the lifting hydraulic cylinder from the lower mast.

* * * * *